United States Patent [19]

Nissl et al.

[11] Patent Number: 4,972,757

[45] Date of Patent: Nov. 27, 1990

[54] RANGING GUN WITH ELECTROMAGNETIC ACCELERATION SYSTEM

[75] Inventors: Norbert Nissl, Aresing; Peter Grossler, Hochstadt, both of Fed. Rep. of Germany

[73] Assignee: Messerschmitt-Bölkow-Blohm GmbH, Munich, Fed. Rep. of Germany

[21] Appl. No.: 35,019

[22] Filed: Mar. 13, 1987

[30] Foreign Application Priority Data

Mar. 17, 1986 [DE] Fed. Rep. of Germany ..... 3608840

[51] Int. Cl.[5] ..... F41B 6/00

[52] U.S. Cl. ..... 89/8; 124/3; 315/111.610

[58] Field of Search ..... 89/8; 124/3; 310/10, 310/11, 12; 313/231.41; 315/111.61

[56] References Cited

U.S. PATENT DOCUMENTS 3,854,097 12/1974 Fletcher et al. ..... 89/8
4,121,123 10/1978 Crolius ..... 310/10
4,698,532 10/1987 Ross ..... 310/11

FOREIGN PATENT DOCUMENTS 2141215 12/1984 United Kingdom ..... 89/8

*Primary Examiner*—Stephen C. Bentley
*Attorney, Agent, or Firm*—Toren, McGeady & Associates

[57] ABSTRACT

The invention is directed to a ranging gun (1a to 1f) for a mass (17, 18) which is to be accelerated. The ranging gun comprises a coaxial system as acceleration system, which coaxial system consists of an outer conductor (2) and an inner conductor (3) which are electrically connected with one another by means of a short-circuit bridge (9) which terminates the coaxial system. In the coaxial system, a strong current pulse is fed at one side. Next, an explosive charge, which is aligned along the coaxial system, is ignited at the feed location so that the outer and inner conductors (2, 3) contact and a closed hollow space (10) is formed. The front termination is formed by a plasma bridge (11) which has formed from the short-circuit bridge (9) by means of the vaporization of the bridge material after feeding the strong current pulse. The magnetic field enclosed in the hollow space (10) is compressed by means of the forward moving detonation front, wherein, by means of adapting the mass of the plasma bridge (11), the dimensioning of the hollow space (10) can be adjusted along the entire compression distance in such a way that magnetic field compression occurs.

16 Claims, 8 Drawing Sheets

RANGING GUN WITH ELECTROMAGNETIC ACCELERATION SYSTEM

Figures 1A, 1B:
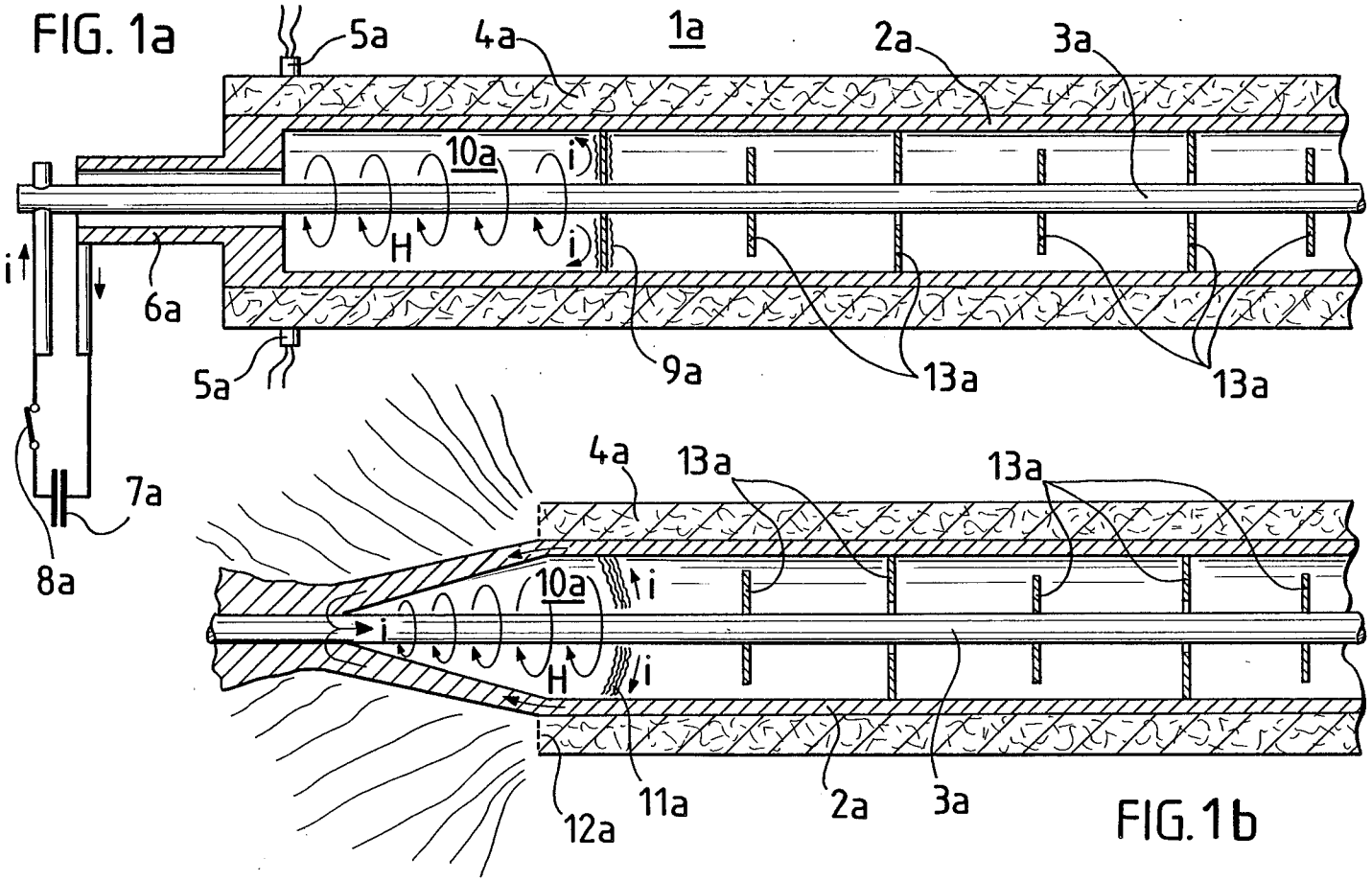

The invention is directed to a ranging gun for a mass to be accelerated including a coaxial system consisting of outer and inner conducters electrically connected with one another on one side by means of a short circuit bridge which terminates the coaxial system.

A ranging gun for a projectile which is to be fired is known from the Applicant's own DE-OS 33 21 034, in which ranging gun the projectile is expelled from the gun with the aid of an electromagnetic acceleration drive. The electromagnetic acceleration drive makes use of the fact that by means of a rapid compression of a hollow space with electrically conductive walls, which enclose a corresponding magnetic field, the magnetic energy of the hollow space can be increased approximately linearly with the compression factor. The work accomplished against the pressure of the magnetic field is converted into magnetic energy.

The acceleration drive in the known gun has a coaxial system consisting of an outer conductor and an inner conductor which are electrically connected at the front by means of a short-circuit bridge which closes the coaxial system. In this coaxial system, which is electrically short-circuited on one side, a current pulse is fed in, e.g. by means of a capacitor discharge, so that a magnetic field is generated in the coaxial system. Approximately at the moment at which the current pulse is at the maximum amplitude, an explosive charge is ignited which is aligned along the coaxial system and, e.g. encloses the outer conductor of the coaxial system. The ignition is effected in the vicinity of the feed point of the current pulse, by means of which the outer and inner conductors approach one another until the electrical short circuit. The above-mentioned hollow space, which encloses the magnetic field, is produced by means of this short circuit.

The rear short circuit of the coaxial system, which is produced between the outer and inner conductors by means of the explosive charge, moves forward at the speed of the detonation front so that the hollow space is constantly reduced and the magnetic field enclosed therein is compressed. The speed of the detonation front is approximately 8 km per second. The electrical parameters of the coaxial system are selected in such a way that the decay time of the magnetic field is approximately one order of magnitude above the maximum duration of the entire compression process, so that relatively slight ohmic losses occur. At an optimal coordination of the system, the largest possible portion of the originally available electrostatic energy can be converted into magnetic energy.

The high field pressure which is generated in this manner acts on the electrically conductive projectile which is expelled from the gun. The projectile itself can be part of the short-circuit bridge between the outer and inner conductors.

In this process, work is accomplished against the field pressure in the interior of the coaxial distance by means of the liberated mechanical energy of the detonation and is converted into magnetic field energy corresponding to the principle of electrodynamic machines. The rate of conversion increases over wide ranges of the compression factor approximately proportionally to the magnetic energy of the coaxial distance. This means that there is also only a low energy conversion rate at the start of the compression- process; where the intensity of the magnetic field is still relatively slight, i.e. the available energy of the explosive charge is not made use of to a great extent. Only at the end of the compression process, when the field pressure has a sufficiently high value, does the rate of conversion increase. This means that the energy content of the magnetic field increases approximately proportionally with the compression factor, i.e. in an approximately inverse proportion to the respective remaining coaxial distance.

It would be better for all conceivable applications of the generated magnetic field energy to overturn this law, i.e. to achieve higher rates of conversion from the start.

It is the object of the invention to improve the construction of a ranging gun of the type in question in such a way that higher energy conversion rates are possible from the start.

The substantial idea of the invention consists in that the coaxial system is not short-circuited at the front end, but, rather, the short-circuit bridge is arranged relatively close to the feed point of the current pulse. This short-circuit bridge can be a thin plate or foil, e.g. of aluminum. When the current pulse is fed in, the material of this short-circuit bridge vaporizes and forms a plasma bridge between the outer conductor and the inner conductor. This plasma bridge now forms the front end of the hollow space in which the magnetic field is enclosed after the detonation of the explosive charge at the place where the current pulse is fed. In order to achieve a magnetic field compression within this hollow space, with its movable front wall which is formed by the plasma bridge, the detonation front, which is moving at high speed in the direction of the front end of the coaxial system, or the rear short circuit of the coaxial system, which is compulsorily coupled with the latter, may in no case outdistance the plasma bridge, since the enclosed magnetic field energy would otherwise be transformed into Joule's heat or could no longer be transported forward. On the other hand, the plasma bridge must not be driven forward too quickly by the pressure of the enclosed magnetic field, since the compression factor would decrease and the desired effect would not be possible.

These two requirements are met by means of a corresponding choice of the mass of the short-circuit plate which substantially determines the inert mass of the conductive plasma formed from it. Accordingly, exactly the correct mass barrier can be adjusted so that the necessary forward movement of the plasma bridge relative to the detonation front, which is running behind it, is ensured, and so that it is ensured that this forward movement is not too great, i.e. that the compression factor does not decrease.

The short-circuit bridge must not be arranged too close to the feed point of the current pulse in order to avoid excessive initial energy losses. Such energy losses are, for example, the division of the magnetic field energy into the parasitic inductance of the feed line and the useful inductance of the compression distance.

According to a preferred embodiment form of the invention, at least one rotational body, e.g. a thin plate or thin-walled cone, which does not electrically connect the outer conductor and inner conductor, but is included in the plasma bridge during the forward movement of same, is provided in the movement direction of the detonation front of the explosive charge so as to be connected to the short-circuit bridge. The rotational body can consist of electrically conductive or insulating material or a combination of these. As soon as the plasma bridge strikes the next rotational body when advancing, e.g. a plate of aluminum, the material of this plate is included in the current flow, vaporized and carried along in the plasma as additional mass. The rate of this mass feed can be optimally adjusted by means of a corresponding selection of the mass of the rotational body, e.g. the plate thickness and the individual distances, so that a maximum rate of conversion of explosives energy into magnetic field energy or kinetic energy of the plasma results according to the instance of application. Adjustments which can meet various optimization criteria along different sections of the coaxial distance are also possible. It is also possible to include electrically nonconductive materials in the plasma bridge by means of a layer construction of the rotational bodies in order, for example, to achieve a forward flow of neutral material. The rotational bodies can be shaped in different ways in order to achieve a front shaping effect of the forward moving plasma bridge.

The material of the plasma bridge or the neutral material which is carried along can itself be the mass which is to be accelerated, e.g. it can be expelled from the coaxial system like a shell. However, it is also possible that this accelerated material impacts against a projectile arranged in a barrel and is expelled from the barrel by means of the impact of the material of the plasma bridge.

According to another embodiment form, the inner conductor of the coaxial system is omitted from the front part of the compression distance. This is possible because the conductive plasma of the plasma bridge, which plasma is formed and continuously reformed, changes shape, i.e. stretches, in the ring-shaped, strong magnetic field in such a way that it substitutes for the inner conductor. The continuous feed of mass to the plasma occurs by means of corresponding rotational bodies, e.g. plates, which fill up the entire cross section of the outer conductor. In addition, the outer conductor can be reduced conically in the front part of the compression distance, wherein the inner conductor ends in front of, within or after the conically reducing transition. Such a construction serves to further accelerate the plasma bridge and the material contained therein shortly before expulsion.

As already mentioned, the rotational bodies within the acceleration system can have different shapes, thicknesses, materials or combinations of materials in order to bring about special effects, but particularly for the purpose of shaping the front of the plasma bridge. A combination of electrically conductive and electrically nonconductive rotational bodies is especially effective in order to keep nonconductive hypersonic material at the front of the plasma bridge; the nonconductive hypersonic material then leaves the acceleration system in a directed manner directly as an amorphous bundle of material. This electrically neutral bundle of material is not subject to electromagnetic forces, which, for example, expand the subsequent conductive plasma from the plasma bridge, after leaving the acceleration system.

Figure 2A:
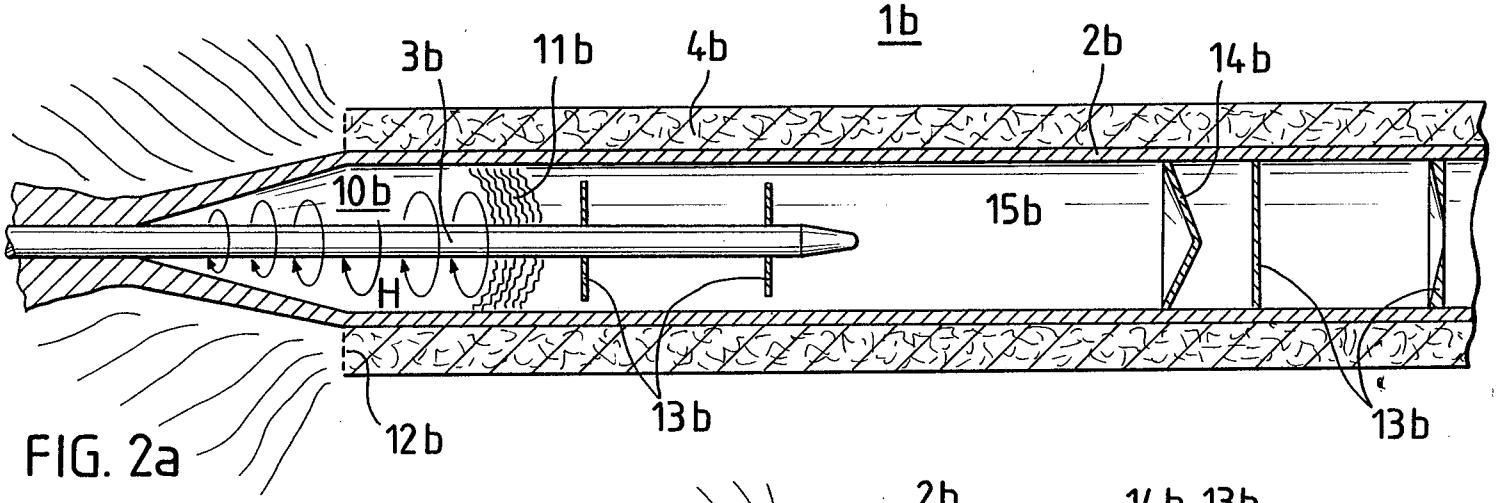
Figure 2B:
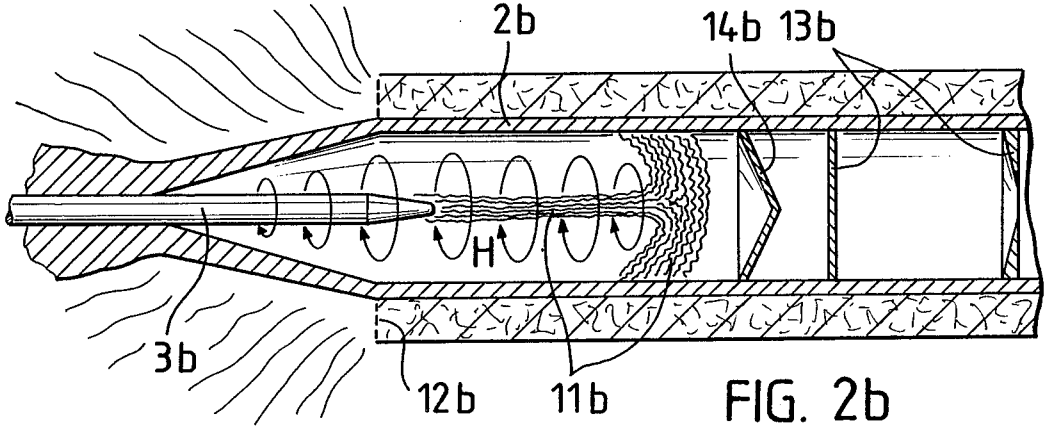
Figure 4:
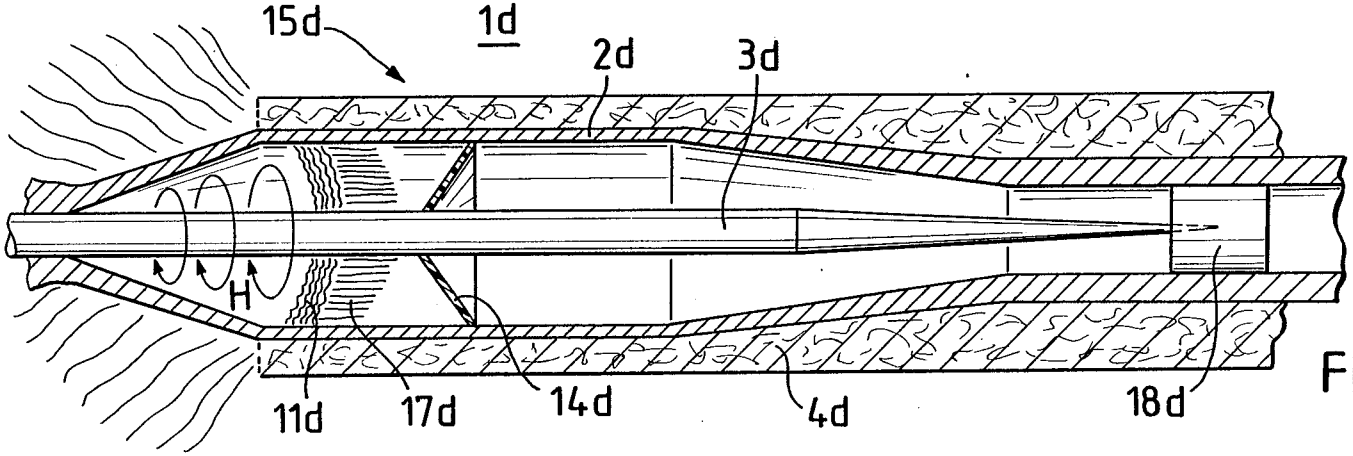
Figure 5:
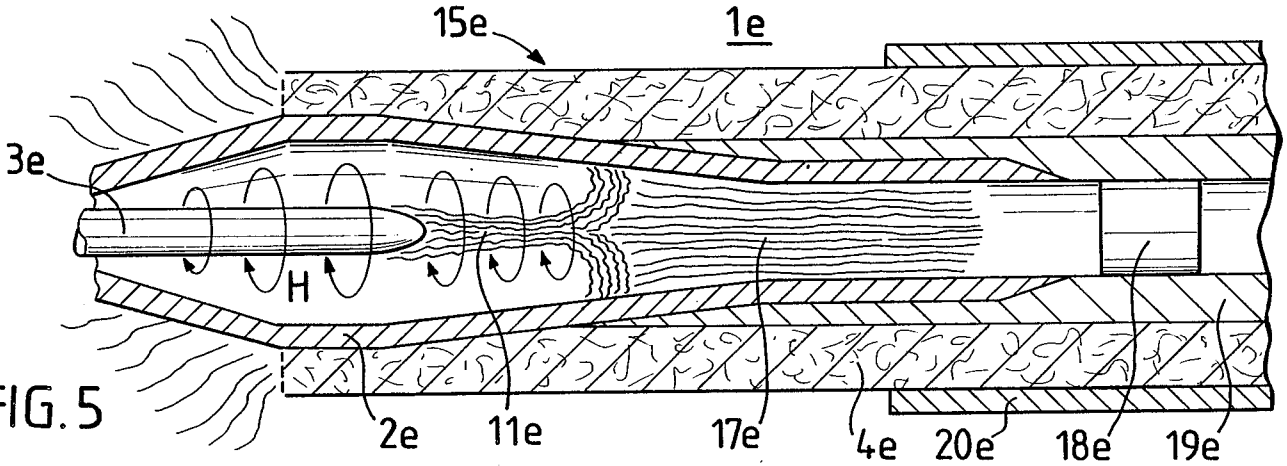
Figure 6:
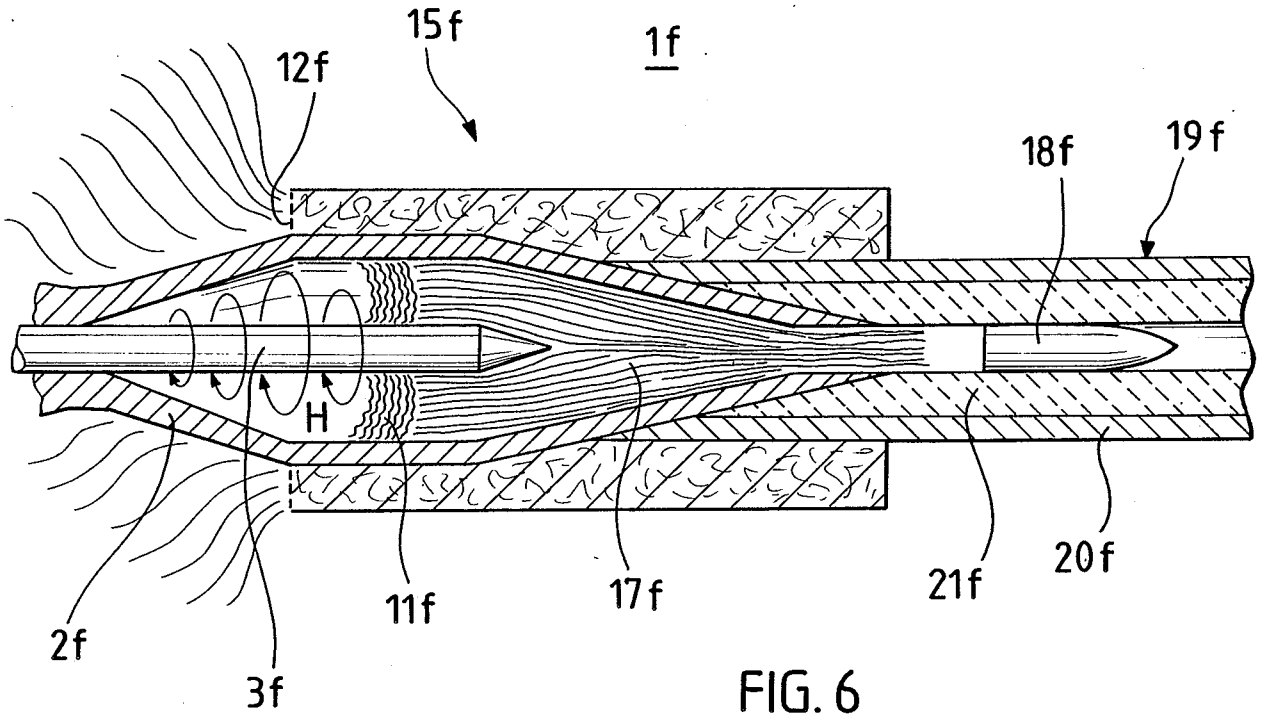

The invention is explained in more detail in several embodiment examples with the aid of the drawing. Shown are:

FIGS. 1*a*–1*d* show a schematic longitudinal section through a portion of a ranging gun, according to the invention, comprising a coaxial system and an explosive charge enveloping the latter, and showing at consecutive moments following the ignition of the explosive charge;

FIGS. 2*a*, 2*b* show two schematic longitudinal sections through a modified embodiment example of a ranging gun according to the invention, FIGS. 3*a*–3*f* show a third embodiment example of a ranging gun at consecutive moments following the ignition of the explosive charge;

FIGS. 4 and 5 show schematic longitudinal sections through the front area of two additional embodiment examples of a ranging gun, according to the invention, for accelerating an amorphous projectile; and FIG. 6 show a schematic longitudinal section through the front area of a ranging gun, according to the invention, for accelerating a hard-metal projectile.

The same reference numbers are used for identical or identically acting parts in the figures, but with the addition of letters a to f corresponding to FIGS. 1 to 6.

FIG. 1*a* shows the rear portion of a ranging gun 1*a* with electromagnetic acceleration system. This electromagnetic acceleration system comprises a coaxial system consisting of a cylindrical outer conductor 2*a* and a rodshaped, central inner conductor 3*a*. The outer conductor 2*a* is enclosed by an explosive charge 4*a* along the entire length of the acceleration system. This explosive jacket can be ignited at the rear end of the ranging gun with ignition devices 5*a* which are distributed over the entire circumference of the explosive charge. The inner conductor 3*a* is drawn out over the rear end of the ranging gun and is tightly enclosed in this location by a cylindrical end portion 6*a* which is connected with the outer conductor 2*a*. The outer and inner conductors are very favorably electrically conductive, e.g. consist of copper. The inner conductor 3*a* and the end portion 6*a* of the outer conductor 2*a* are connected with one another by means of a capacitor bank 7 and a switch 8*a*.

The outer conductor 2*a* and the inner conductor 3*a* are electrically connected at a fixed distance from the rear end within the coaxial system by means of a plate-shaped short-circuit bridge 9*a* consisting, e.g., of aluminum. In this manner, a hollow space 10*a* is formed between this short-circuit bridge 9*a* and the rear end of the ranging gun.

Figure 1C:
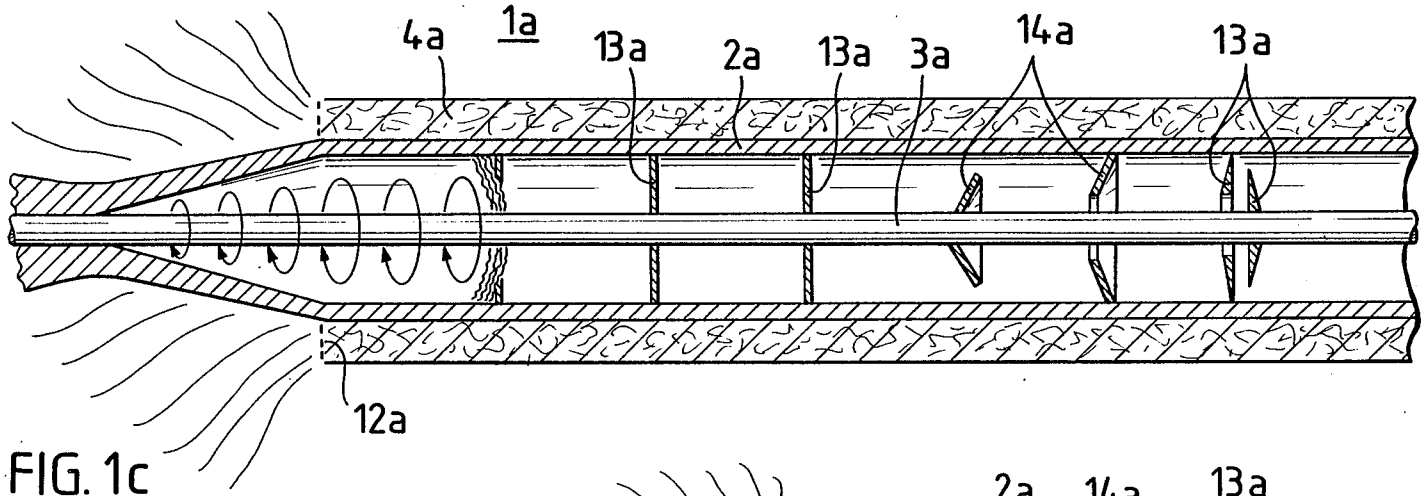
Figure 1D:
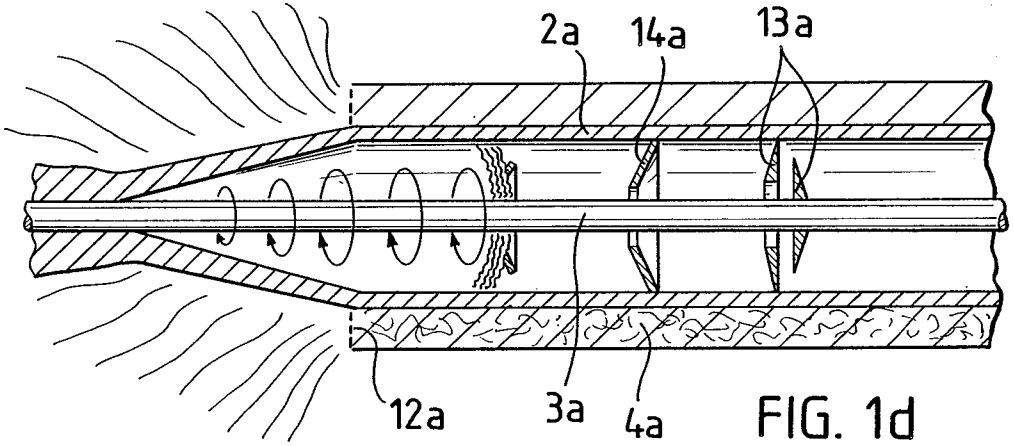

When, with the switch being open first, the capacitor bank 7*a* is charged and the switch 8*a* is then closed, the capacitor bank 2*a* discharges suddenly so that a strong current pulse is generated in the electrically closed circuit consisting of the outer conductor 2*a*, the short-circuit bridge 9*a* and the inner conductor 3*a*, and an electrical eddy field is accordingly produced in the hollow space 10*a*. The strong current i which flows through the short-circuit bridge 9*a* causes the material of the latter to vaporize and form a plasma bridge 11*a* which is indicated in figures 1*b* to 1*d* and now terminates the hollow space 10*a* in the front.

As soon as the fed current pulse reaches its maximum, the explosive charge 4*a* is ignited by means of the ignition device 5*a*. The outer conductor 2*a* is accordingly pressed together until it contacts the inner conductor 3*a* in the end area and accordingly supplies another short circuit in this location. The hollow space 10*a* is now closed off electrically on all sides. The enclosed magnetic field H acts on the material of the plasma bridge 11*a* and propels the latter to the right in the figures. At the same time, the detonation front 12*a*, which is indicated in figures 1*b* to 1*d*, likewise moves to the right within the explosive charge 4*a*. In order to achieve a magnetic field compression within the hollow space 10*a*, the mass of the plasma bridge must be correspondingly selected.

The mass of the plasma bridge can be changed in the course of its forward movement and optimally adapted to the respective magnetic field compression. For this purpose, rotational bodies, which are constructed here as plates 13*a*, consist of electrically conductive material and are connected in an alternating manner with the inner conductor 3*a* and the outer conductor 2*a*, but do not produce an electrical connection to the counter-conductor, are provided along the inner conductor 3*a* at fixed distances.

As soon as the plasma bridge 11*a*, shown in figure 1*b*, strikes the next plate 13*a* connected with the inner conductor 3*a*, the material of this plate is incorporated in the current flow of the plasma bridge, vaporized and carried along in the plasma bridge as additional mass. This is repeated with the next plate connected with the outer conductor, and so on.

FIGS. 1*c* and 1*d* show the front area of the ranging gun 1*a*. Additional rotational bodies 14*a*, which are constructed in this instance as truncated cones, are formed in this area. The arrangement of such shaped rotational bodies substantially serves to shape the front of the plasma bridge 11*a*.

FIGS. 2*a* and 2*b* show the front area of a ranging gun 1*b*. The explosive charge 4*b* is already extensively burned away, the hollow space 10*b* is terminated at the front by means of a plasma bridge 11*b* which is already relatively strong. In this embodiment form, the inner conductor 3*b* ends already before the front end of the ranging gun, so that the front area 15*b* of the gun now only comprises the outer conductor 2*b*. In FIG. 2*a*, the plasma bridge 11*b* still burns in the area of the inner conductor, on which are arranged two plates 13*b* of electrically conductive material, which will shortly be included in the plasma bridge 11*b*. As soon as the plasma bridge 11*b* leaves the inner conductor 3*b* and enters the front area 15*b*, the conductive plasma of the plasma bridge, which plasma is already developed and continues to develop constantly, is compulsorily shaped in the ring-shaped strong magnetic field H in such a way that it replaces the central conductor, as shown in FIG. 2*b*. Plates 13*b* or cones 14*b* can also be arrange this front area 15*b* of the ranging gun and now span entire interior of the outer conductor 2*b*. These rotational bodies are also integrated in the burning plasma bridge 11*b* and form its front.

Figure 3A:
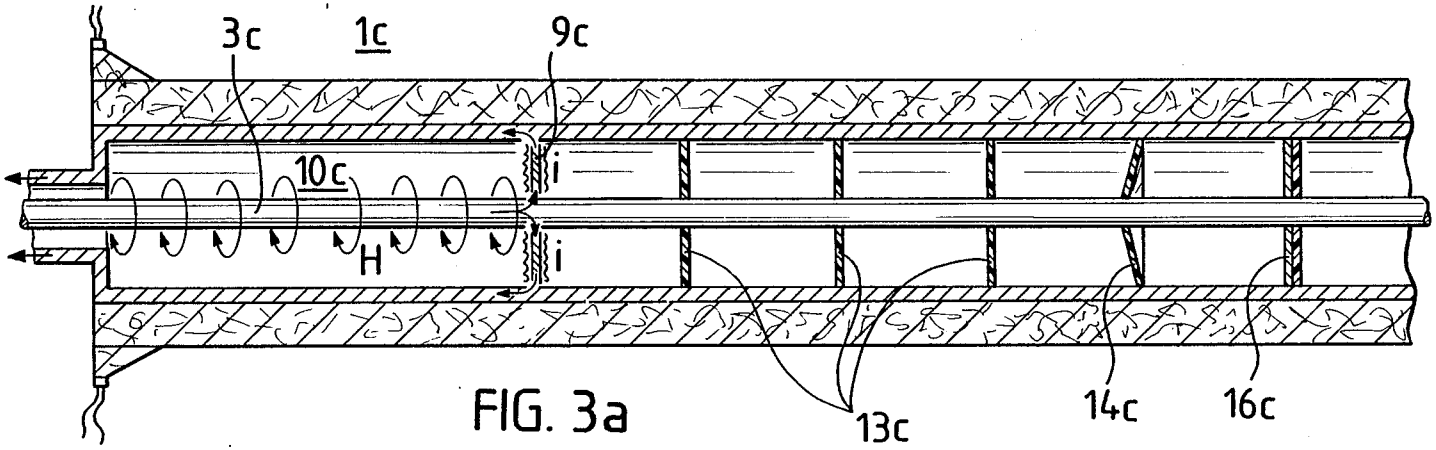
Figure 3B:
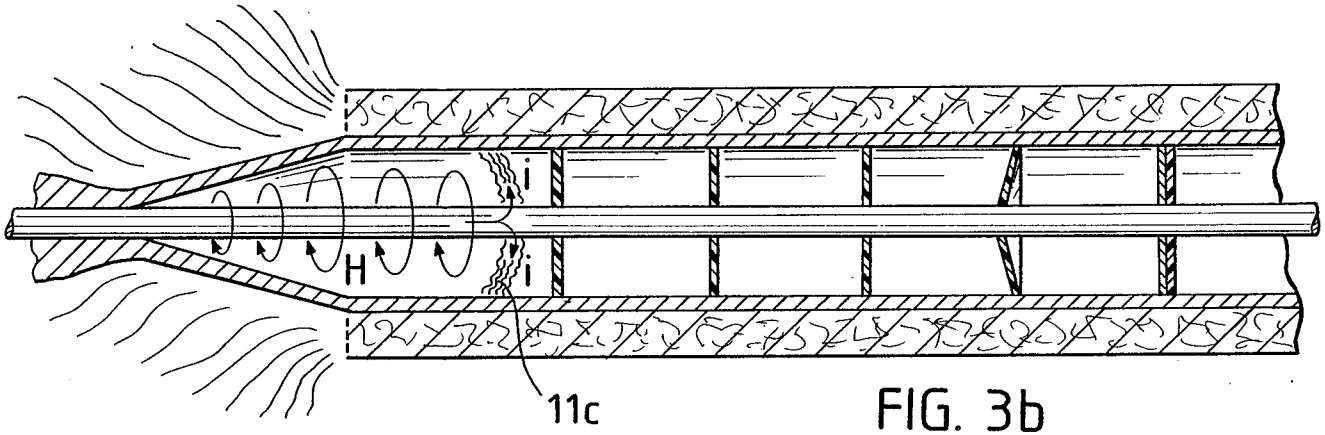
Figure 3C:
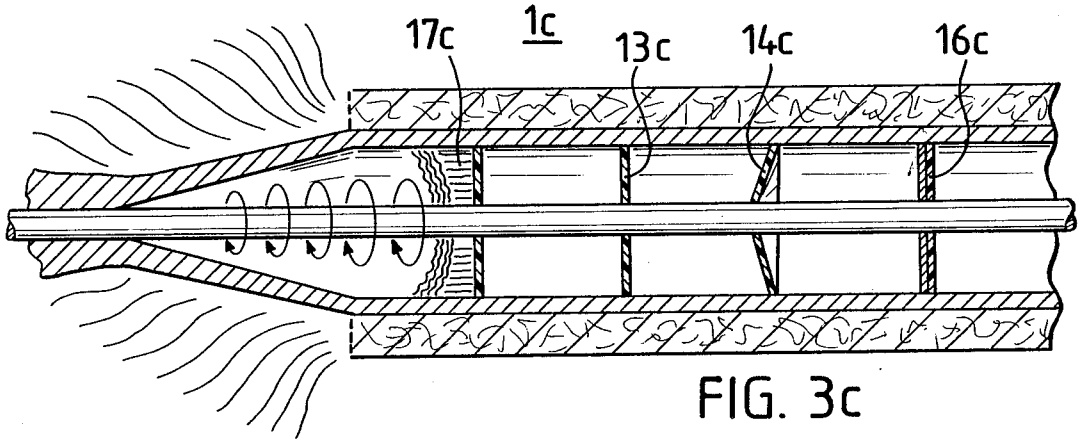
Figure 3D:
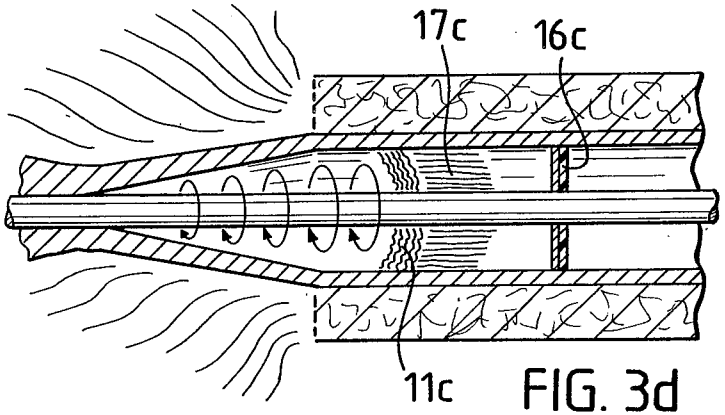

The ranging gun 1*c* shown in FIGS. 3*a* to 3*f* is similar to that of figure 1*a* in its rear area. Accordingly, an eddy field H is formed in the hollow space 10*c* by means of feeding a strong current pulse, which eddy field H surrounds the inner conductor 3*c* in a ring-shaped manner. The inner conductor 3*c* and the outer conductor 2*c* are electrically connected by means of a short-circuit bridge 9*c* which vaporizes after the current pulse is fed in and forms a plasma bridge 11*c*. A plurality of plates 13*c*, a truncated cone 14*c* and another plate 16*c* are arranged along the compression distance, wherein this last plate consists of a plurality of layers of various material, in this instance, two layers. The plates 13*c* consist of nonconductive material, as does the truncated cone 14*c*. In the plate 16*c*, at least one layer can likewise be constructed as a nonconductor. When, in this case, the plasma bridge 11*c* burns and, as shown in FIGS. 3*b* to 3*d*, is continuously pressed to the right by means of the magnetic field H in connection with the explosive charge, a layer or bundle 17*c* of amorphous neutral material accumulates in front of the burning plasma bridge corresponding to FIGS. 3*c* and 3*d*.

Figure 3E:
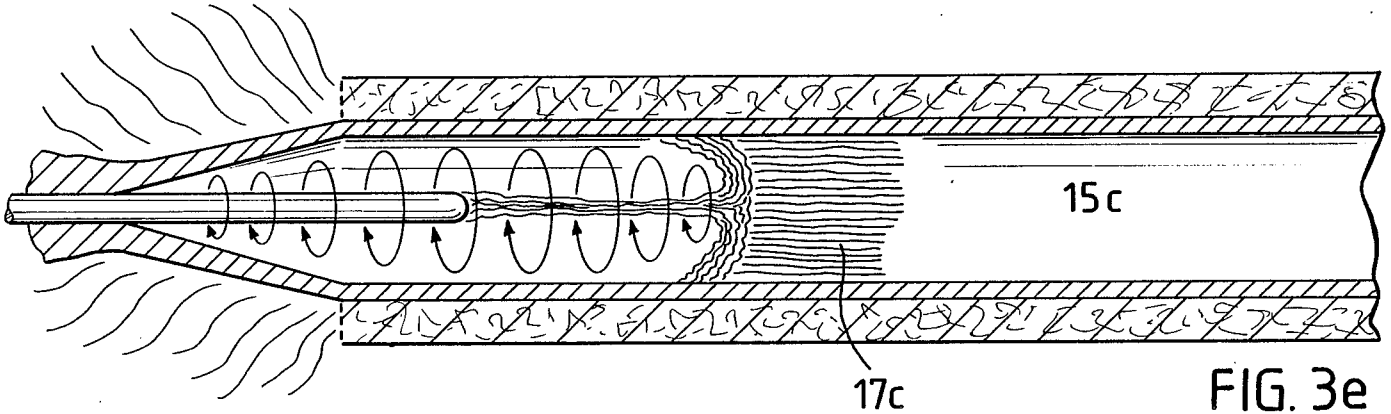
Figure 3F:
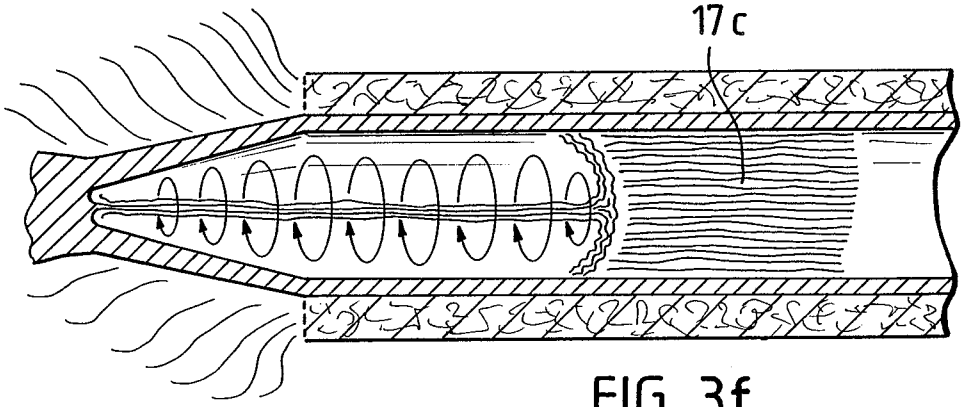

FIG. 3*e* shows the front area 15*c* of the ranging gun, in which the inner conductor 3*c* is omitted. Moreover, no rotational bodies of electrically conductive or non-conductive material are provided in this area. The material bundle 17*c* can be used directly as a projectile which is expelled from the ranging gun in a directed manner.

The continuous mass feed to the plasma bridge also makes it possible for the magnetic field compression to constantly increase, or at least be kept constantly high, until the material bundle 17*c* leaves.

FIG. 4 shows only the front area 15*d* of a ranging gun 1*d*. The compression of the magnetic field is already far advanced, wherein it is assumed that a relatively large material bundle 17*d* has accumulated in front of the plasma bridge 11*d*. A truncated cone-shaped rotational body 14*d* of nonconductive material, which encloses the inner conductor 3*d*, is provided for shaping the leading front of the material bundle 17*d*. The inner cross section of the outer conductor 2*d is reduced conically in the front area 15d*, thereby increasing the speed of the plasma bridge 11*d* and the material bundle 17*d*. The coating of the outer conductor with explosive material 4*d* is also increased in this conically tapering area. This step increases, as a whole, the supply of energy to the plasma bridge and the material bundle. A projectile 18*d* consisting of a nonconductor is stored in the reduced cross section of the outer conductor 2*d*, its mass being dimensioned in such a way that an optimal pulse transmission of the material flow from the bundle 17*c* and the plasma bridge 11*c*, which material flow impacts on it, is ensured. The inner conductor 3*d* ends in the area of the projectile 18*d*.

Such a construction of the front area of the ranging gun is also possible for the aforementioned embodiment forms according to FIGS. 1 to 3.

FIG. 5 shows the front area 15*e* of another ranging gun 1*e*. The outer conductor 2*e* is reduced conically in this area to a small cross section, wherein a projectile 18*d* of electrically nonconductive material is arranged in the portion having a small cross section. The inner conductor 3*e* already ends where the outer conductor is conically reduced, so that the functioning of the inner conductor 3*e* is taken over after this point by the portion of the plasma bridge 11*e* which is stretched by the magnetic field. The plasma bridge 11*e* pushes a large bundle 17*e* of amorphous neutral material in front of itself, whose pulse is transmitted to the projectile 18*d*, and expels this from the gun. The outer conductor 2*e* ends shortly before the resting position of the projectile 18*d* shown in FIG. 5, the barrel 19*e* adjoining the outer conductor 2*e* consists of a material of high tensile strength; in addition, the explosives jacket 4*e* is covered with an outer barrier 20*e* in order to improve the energy transmission in the final phase.

Even if the projectile 18*d* or 18*e* is disintegrated by means of the high impact loads when, in the two embodiment forms according to FIGS. 4 and 5, the material bundle 17*d* or 17*e* impacts against it, a hypersonic amorphous material flow having sufficient mass and orientation, for example, to achieve effects in a vacuum over great distances, is produced as a whole.

FIG. 6 shows another embodiment example of the front area 15*f* of a ranging gun 1*f*. This area can also serve as a terminating area of a ranging gun according to FIGS. 1 to 3. In the embodiment example according to FIG. 6, the outer conductor 2*f* is again reduced conically, wherein the inner conductor 3*f* ends in the conically reduced area. A material bundle 17*f*, which penetrates into the barrel 19*f* with small cross section and impacts there against a projectile of hard metal, is pushed ahead of the plasma bridge 11*f*. The barrel 19*f* consists of an outer steel jacket 20*f* and an inner ceramic lining 21*f*. The construction of the projectile 18*f* as an electrical conductor prevents this projectile from being acted upon and loaded by excessive currents, particularly in cases where the projectile comes into direct contact with plasma, i.e. when no rotational bodies, plates, or the like, consisting of nonconductive material are arranged alont the compression distance.

In general, the forward flowing hypersonic material bundle 17*d*, 17*e* or 17*f* can also only consist of conductive plasma in the embodiment examples according to FIGS. 4 to 6, so, in these cases, the initial compression distance is constructed in accordance with FIGS. 1*a* to 1*d*.

We claim:

1. Ranging gun for a mass which is to be accelerated, comprising a coaxial system comprising outer an inner conductors which are electrically connected with one another on one side by means of a short-circuit bridge which terminates said coaxial system, comprising a device for feeding a current pulse into said coaxial system at its other side, an explosive charge which is aligned along said coaxial system, and an ignition device for said explosive charge located in the vicinity of the feed point for said current pulse, said ignition device being actuated after said current pulse is fed, so that the detonation front of said explosive charge runs in the direction of said short-circuit bridge of said coaxial system and, in so doing, connects said outer and inner conductors with one another along a compression distance until an electrical short circuit (magnetic compression distance until an electrical short circuit (magnetic compression field), characterized in that said coaxial system (2*a* to 2*f*, 3*a* to 3*f*) is lengthened beyond said short-circuit bridge (9, 9*a*, 9*c*) in the movement direction of said detonation front (12*a* to 12*f*), in that said short-circuit bridge (9*a*, 9*c*) comprises an electrically conductive material which passes into the plasma state when said current pulse is fed and forms a plasma bridge (11*a* to 11*f*) between said outer and inner conductors (2*a* to 2*f*, 3*a* to 3*f*), and in that the mass of said plasma bridge (11*a* to 11*f*) is fixed in such a way that a magnetic field compression is made possible along the entirety of said compression distance despite said moving detonation front (12*a* to 12*f*) and plasma bridge (11*a* to 11*f*), at least one rotational body (13*a, b, c*, 14*a, b c, d* 16*c*) is provided in the movement direction of said detonation front (12*a* to 12*f*) of said explosive charge (4*a* to 4*f*) so as to adjoin said short-circuit bridge (9*a*, 9*c*), which rotational body (13*a, b, c*, 14*a, b, c, d*, 16*c*) does not electrically connect said outer and inner conductors (2*a* to 2*f*, 3*a* to 3*f*), but is incorporated in said plasma bridge (11*a* to 11*f*) during the advance of said plasma bridge (11*a* to 11*f*).

2. Gun according to claim 1, characterized in that said rotational bodies (13, 14, 16) comprises electrically conducting material.

3. Gun according to claim 2, characterized in that said rotational bodies (13*a*) are connected only with one of said inner conductor (3*a*) and said outer conductor (2*a*) in an alternating manner so as to be electrically conductive.

4. Gun according to claim 1, characterized in that said rotational bodies (13*c*, 14*c*, 16*c*) comprises electrically nonconductive material.

5. Gun according to claim 1, characterized in that said rotational bodies are thin plates (13) and truncated cones (14).

6. Gun according to claim 1, characterized in that said rotational bodies (16*c*) are constructed from a plurality of material layers.

7. Gun according to claim 1, characterized in that a front portion (15*c, d, e, f*) of said compression distance is free of said inner conductor.

8. Gun according to claim 7, characterized in that said outer conductor (2*d, e, f*) is a conically reduced portion in the front portion (15*b, e, f*) of said compression distance.

9. Gun according to claim 8, characterized in that said inner conductor (3*d*) ends after the conically reduced portion of said outer conductor (2*d*).

10. Gun according to claim 8, characterized in that said inner conductor (3*f*) ends in the area of the conically reduced portion of said outer conductor (2*f*).

11. Gun according to claim 8, characterized in that said inner conductor (2*e*) ends before said conically reduced portion of said outer conductor (2*e*).

12. Gun according to claim 7, characterized in that the coating of said compression distance with said explosive charge (4*a* to 4*f*)increases in said front portion (15*d*) of said compression distance per unit of length.

13. Gun according to claim 7, characterized in that said front portion (15*e*) of said compression distance is enclosed by an outer barrier (20*e*).

14. Gun according to claim 7, characterized in that a projectile (18*d, e, f*), which is to be accelerated, is introduced in said front portion (15*d, e, f*) of said compression distance.

15. Gun according to claim 14, characterized in that said projectile (18*d, e*) consists of electrically nonconductive material.

16. Gun according to claim 14, characterized in that said projectile is a hard-metal projectile.

* * * * *